US012473671B2

(12) United States Patent
Kawabata et al.

(10) Patent No.: US 12,473,671 B2
(45) Date of Patent: Nov. 18, 2025

(54) DOUBLE KNIT CIRCULAR KNITTED FABRIC, MANUFACTURING METHOD THEREOF, KNITTED PRODUCT, AND KNITTED FABRIC HOLDING ATTACHMENT

(71) Applicants: HAYASHI TELEMPU CORPORATION, Nagoya (JP); HONDA MOTOR CO., LTD., Tokyo (JP)

(72) Inventors: Atsushi Kawabata, Nagoya (JP); Tomoyuki Uemura, Tokyo (JP)

(73) Assignees: HAYASHI TELEMPU CORPORATION, Nagoya (JP); HONDA MOTOR CO., LTD., Nagoya (JP)

( * ) Notice: Subject to any disclaimer, the term of this patent is extended or adjusted under 35 U.S.C. 154(b) by 0 days.

(21) Appl. No.: 18/884,115

(22) Filed: Sep. 13, 2024

(65) Prior Publication Data

US 2025/0137176 A1 May 1, 2025

(51) Int. Cl.
*D04B 1/10* (2006.01)
*D04B 1/22* (2006.01)

(52) U.S. Cl.
CPC ..... *D04B 1/104* (2013.01); *D04B 1/22* (2013.01)

(58) Field of Classification Search
CPC ..... D04B 1/102; D04B 1/104; D04B 1/22; D04B 9/08; D04B 9/26; D04B 9/28; D04B 9/38; D04B 21/06; D04B 21/10; D04B 21/20; D10B 2403/0213
See application file for complete search history.

(56) References Cited

U.S. PATENT DOCUMENTS 5,651,847 A * 7/1997 Loeffler ..... D04B 1/16 66/196
7,213,421 B2 * 5/2007 Shirasaki ..... D04B 21/14 66/196
7,565,821 B2 * 7/2009 Park ..... B60N 2/976 66/195
7,913,520 B1 * 3/2011 Chen ..... D04B 1/16 66/196
10,251,436 B2 * 4/2019 Carter ..... A41D 15/005
(Continued)

FOREIGN PATENT DOCUMENTS

CN 119877186 A * 4/2025 ..... D04B 21/202
JP S59137547 A * 8/1984
(Continued)

OTHER PUBLICATIONS

Japanese Notice of Reasons for Refusal dated Jul. 8, 2025.

*Primary Examiner* — Danny Worrell
(74) *Attorney, Agent, or Firm* — Yokoi & Co., U.S.A.; Toshiyuki Yokoi

(57) ABSTRACT

A double knit circular knitted fabric includes a front knitted fabric having a first stitch structure of front yarns, a back knitted fabric having a second stitch structure of back yarns, and a binding structure in which the front knitted fabric and the back knitted fabric are bound together with binding yarns. The front knitted fabric has a bottomed hole that is recessed from a surface of the front knitted fabric and connected to the back knitted fabric, and the front yarns drawn into the back knitted fabric are located on a side of the bottomed hole.

4 Claims, 9 Drawing Sheets

(56) References Cited

U.S. PATENT DOCUMENTS

| | | | | |
|---|---|---|---|---|
| 10,597,805 | B2 * | 3/2020 | Takahashi | D04B 21/10 |
| 10,945,482 | B2 * | 3/2021 | Schoppel | D04B 1/102 |
| 11,105,025 | B2 * | 8/2021 | Boylu | D04B 21/04 |
| 11,299,829 | B2 * | 4/2022 | Meir | D04B 15/362 |
| 11,434,588 | B2 * | 9/2022 | Mueller | B68G 7/02 |
| 11,708,651 | B2 * | 7/2023 | Lee | D04B 7/04 66/169 R |
| 11,712,077 | B2 * | 8/2023 | Moretti Polegato | A41D 31/125 428/90 |
| 11,828,008 | B2 * | 11/2023 | Jiang | D04B 1/104 |
| 12,180,626 | B2 * | 12/2024 | Lu | B32B 5/073 |
| 2002/0104335 | A1 * | 8/2002 | Shirasaki | D04B 21/02 66/196 |
| 2002/0157429 | A1 * | 10/2002 | Matsumoto | D04B 21/10 66/195 |
| 2007/0238392 | A1 * | 10/2007 | Starbuck | D04B 1/18 66/149 R |
| 2009/0104404 | A1 * | 4/2009 | Polegato Moretti | A41D 31/102 428/221 |
| 2022/0282409 | A1 * | 9/2022 | Hendry | D04B 1/126 |
| 2025/0137176 | A1 * | 5/2025 | Kawabata | D04B 1/22 |

FOREIGN PATENT DOCUMENTS

| | | | | | |
|---|---|---|---|---|---|
| JP | 3080618 | U | | 10/2001 | |
| JP | 2005-226167 | A | | 8/2005 | |
| JP | 2013087379 | A | * | 5/2013 | D04B 1/22 |

* cited by examiner

ST2

COMPARATIVE EXAMPLE

COMPARATIVE EXAMPLE

COMPARATIVE EXAMPLE

DOUBLE KNIT CIRCULAR KNITTED FABRIC, MANUFACTURING METHOD THEREOF, KNITTED PRODUCT, AND KNITTED FABRIC HOLDING ATTACHMENT

CROSS-REFERENCES TO RELATED APPLICATIONS

The present application is related to the Japanese Patent Application No. 2023-183055, filed Oct. 25, 2023, the entire disclosure of which is expressly incorporated by reference herein.

FIELD OF THE INVENTION

The present invention relates to a double knit circular knitted fabric, a knitted product, a method for manufacturing the double knit circular knitted fabric, and a knitted fabric holding attachment.

DESCRIPTION OF RELATED ART

Thick double raschel knitted fabrics with a mesh structure are used as cover materials for automobile seats. The double raschel knitted fabric has a three-dimensional structure in which a front knitted fabric with the mesh structure and a back knitted fabric are bound together with connecting yarns. The double raschel knitted fabric is knitted by a double raschel machine, which is a type of warp knitting machine. The mesh structure knitted by the double raschel machine has holes, and the holes penetrate through the front knitted fabric. Consequently, the back knitted fabric is visible through each of the through holes of the front knitted fabric.

A double raschel knitted fabric is shown in Utility Model Registration No. 3080618. In the aforementioned double raschel knitted fabric, a back knitted fabric visible from a first mesh column of the front knitted fabric and a back knitted fabric visible from a second mesh column of the front knitted fabric exhibit different hues from each other.

BRIEF SUMMARY OF THE INVENTION

Unfortunately, the double raschel knitted fabric is expensive. Moreover, in the case that scraps such as crumbs or hairs enter the through holes of the front knitted fabric, the scraps may penetrate between the front knitted fabric and the back knitted fabric. This makes it difficult to remove the scraps from the double raschel knitted fabric.

The above-mentioned issues can also apply to cover materials for child seats, cover materials for care beds, and the like.

The present invention discloses a novel knitted fabric that can prevent scraps from penetrating from a surface hole into a space between a front knitted fabric and a back knitted fabric inexpensively, a knitted product including the knitted fabric, a method for manufacturing the knitted fabric, and a knitted fabric holding attachment to be used in the manufacturing method.

One aspect of the present invention provides a double knit circular knitted fabric comprising:

- a front knitted fabric having a first stitch structure of front yarns;
- a back knitted fabric having a second stitch structure of back yarns; and

- a binding structure in which the front knitted fabric and the back knitted fabric are bound together with binding yarns, wherein
- the front knitted fabric has a bottomed hole that is recessed from a surface of the front knitted fabric and connected to the back knitted fabric, and
- the front yarns drawn into the back knitted fabric are located on a side of the bottomed hole.

Another aspect of the present invention provides a knitted product comprising the double knit circular knitted fabric.

Another aspect of the present invention provides a method for manufacturing a double knit circular knitted fabric using a double knit circular knitting machine including a needle cylinder on which cylinder needles are arranged, a needle dial on which dial needles are arranged, a needle selector, and a support body located outside the needle cylinder, the method comprising:

- a holding step of holding a knitted fabric with a spring steel wire so as to prevent knitting yarns from getting entangled at a holding position between the cylinder needles and the dial needles, the spring steel wire leading to the holding position from an attachment base attached to a support body; and
- a control step of controlling operations of the cylinder needles and the dial needles, and a supply of the knitting yarns so as to the double knit circular knitted fabric is knitted, the knitting yarns including front yarns, back yarns, and binding yarns, the double knit circular knitted fabric including a front knitted fabric having a first stitch structure of the front yarns, a back knitted fabric having a second stitch structure of the back yarns, and a binding structure in which the front knitted fabric and the back knitted fabric are bound together with the binding yarns, the front knitted fabric having a bottomed hole that is recessed from a surface of the front knitted fabric and connected to the back knitted fabric, the front yarns being drawn into the back knitted fabric, and the front yarns being located on a side of the bottomed hole.

Another aspect of the present invention provides a knitted fabric holding attachment to be attached to a double knit circular knitting machine including a needle cylinder on which cylinder needles are arranged, a needle dial on which dial needles are arranged, a needle selector, and a support body located outside the needle cylinder, the knitted fabric holding attachment holding a knitted fabric so as to prevent knitting yarns from getting entangled at a holding position between the cylinder needles and the dial needles, the knitted fabric holding attachment comprising:

- an attachment base to be attached to the support body; and
- a spring steel wire that leads to the holding position from the attachment base so as to hold the knitted fabric at the holding position.

These and other features, aspects, and advantages of the invention will be apparent to those skilled in the art from the following detailed description of preferred non-limiting exemplary embodiments together with the drawings and the claims.

DETAILED DESCRIPTION OF THE INVENTION

Some embodiments of the present invention will be described below. Of course, the following embodiments are examples merely illustrative of the present invention, and all features shown in the embodiments may not be necessarily essential to the solution.

(1) Outlines of the Present Disclosure

First, outlines of the present disclosure are given referring to examples shown in FIGS. 1-11. The figures in the present application are schematic examples, magnification ratio in each direction shown in these figures may differ, and the figures may not be consistent. Of course, each element of the present disclosure is not limited to the specific examples indicated by the reference letters.

In the present application, the numerical range "Min to Max" refers to the minimum value Min or more and the maximum value Max or less.

Embodiment 1

Figure 1:
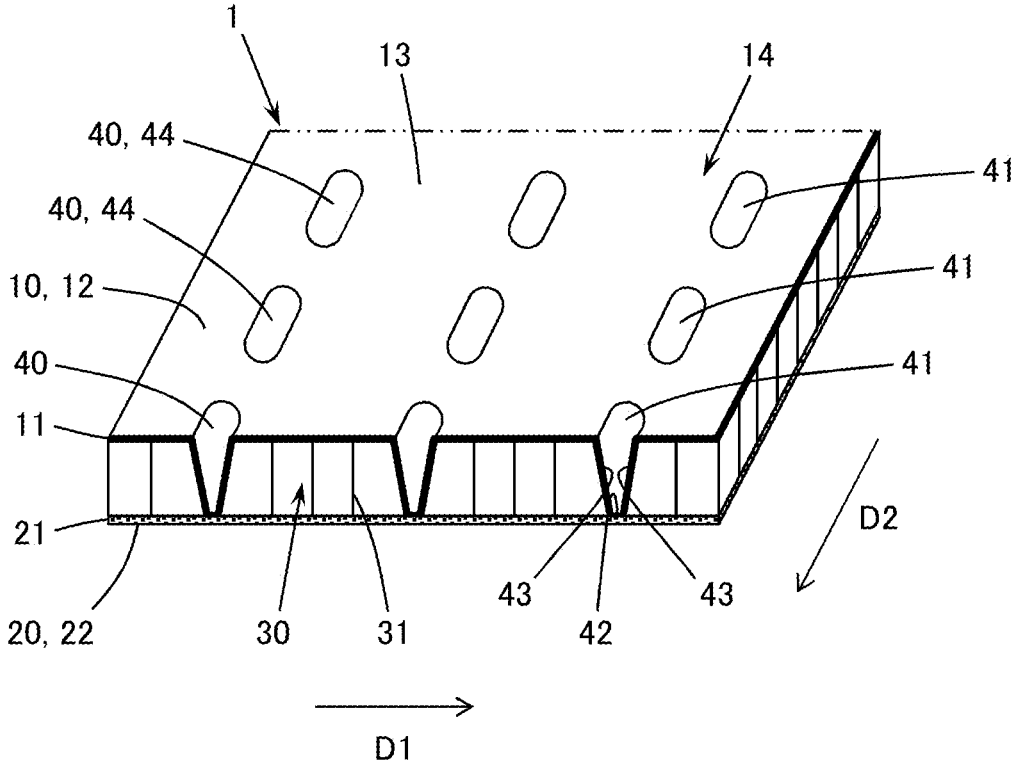
FIG. 1 is a schematic perspective view showing an example of a double knit circular knitted fabric.
Figure 2:
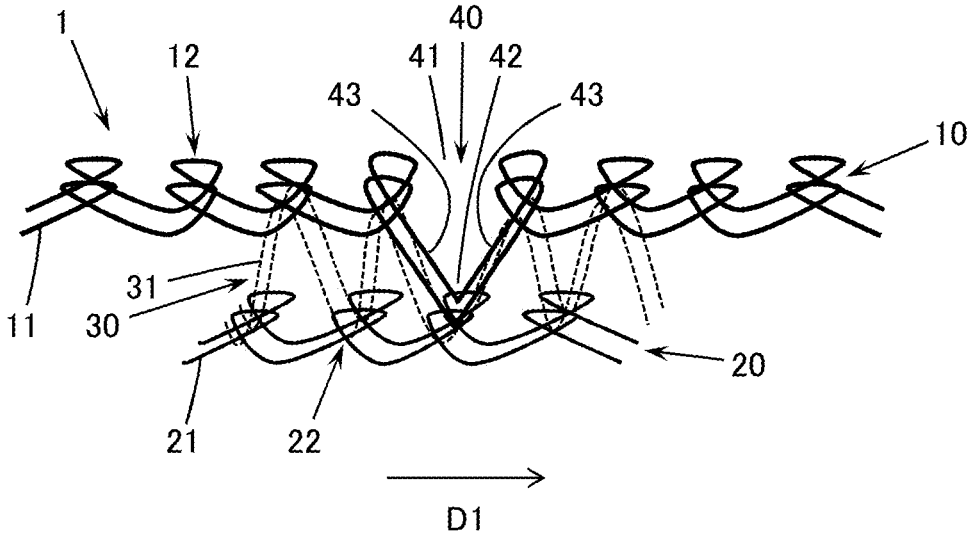
FIG. 2 is a schematic view showing an example of a knitting structure of a double knit circular knitted fabric.

As exemplified in FIGS. 1, 2, etc., one embodiment of the present disclosure provides a double knit circular knitted fabric 1 comprises a front knitted fabric 10 having a first stitch structure 12 of front yarns 11, a back knitted fabric 20 having a second stitch structure 22 of back yarns 21, and a binding structure 30 in which the front knitted fabric 10 and the back knitted fabric 20 are bound together with binding yarns 31. The front knitted fabric 10 has a bottomed hole 40 that is recessed from a surface 13 of the front knitted fabric 10 and connected to the back knitted fabric 20, and the front yarns 11 drawn into the back knitted fabric 20 are located on a side 43 of the bottomed hole 40.

Since the front knitted fabric 10 and the back knitted fabric 20 are bound together with the binding yarns 31, the double knit circular knitted fabric 1 is thick and can be used as a corrugated knitted fabric (carton knit) and the like. The front knitted fabric 10, which has the stitch structure 12 of the front yarns 11 that are weft yarns, has the bottomed hole 40 that is recessed from the surface 13 and connected to the back knitted fabric 20, and the front yarns 11 drawn into the back knitted fabric 20 are located on the side 43 of the bottomed hole 40. This prevents scraps such as crumbs 301 or hairs 302 from penetrating between the front knitted fabric 10 and the back knitting 20 even if the scraps enter the bottomed hole 40, as exemplified in FIG. 8.

Figure 9:
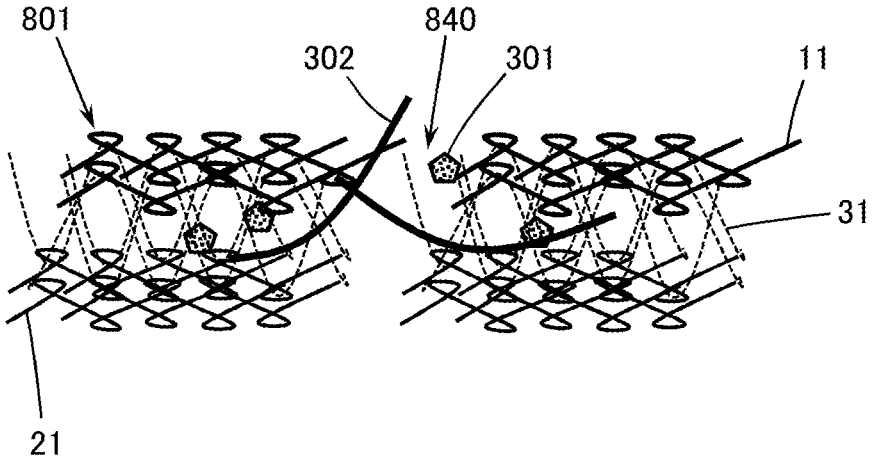
FIG. 9 is a schematic view showing a knitting structure of a double raschel knitted fabric according to a comparative example.

FIG. 9 schematically shows a knitting structure of a double raschel knitted fabric 801 according to a comparative example. The double raschel knitted fabric 801 includes a front knitted fabric made of front yarns 11 that are warp yarns, a back knitted fabric made of back yarns 21 that are warp yarns, and a binding structure. The front knitted fabric is knitted so that through holes will be formed on the front knitted fabric by the front yarns 11 swung in a weft direction. The back knitted fabric is knitted by the back yarns 21 swung in a weft direction. In the binding structure, the front knitted fabric and the back knitted fabric are bound together with binding yarns 31. Due to the structure of the double raschel machine, the front yarns 11 are unable to go around the back. This causes the binding yarns 31 to appear on the side of holes 840 visible on the front knitted fabric. For this reason, if the scraps such as the crumbs 301 or the hairs 302 enter the holes 840, the scraps (301 and 302) will penetrate between the front knitted fabric and the back knitted fabric. This makes it difficult to remove these scraps (301 and 302) from the double raschel knitted fabric 801.

Figure 8:
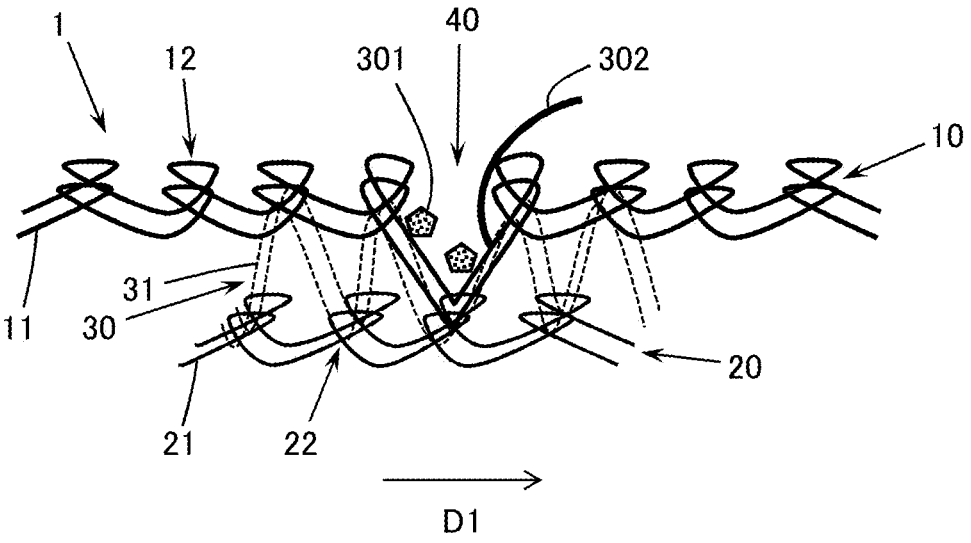
FIG. 8 is a schematic view exemplifying a prevention of penetration of scraps from a surface hole into a space between a front knitted fabric and a back knitted fabric.

In the double knit circular knitted fabric 1 exemplified in FIG. 8, the front yarns 11 drawn into the back knitted fabric 20 are located on the side 43 of the bottomed hole 40. This prevents the scraps from penetrating from the bottomed hole 40 into the space between the front knitted fabric 10 and the back knitted fabric 20. Thus, the above embodiment 1 can provide a novel double knit circular knitted fabric capable of preventing the scraps from penetrating from the surface hole into the space between the front knitted fabric and the back knitted fabric inexpensively.

Herein, the bottomed hole refers to a hole having a bottom. The front yarns are drawn into the back knitted fabric at the bottom of the bottomed hole of the front knitted fabric. The bottomed hole has a size of at least one course in the warp direction.

The above-mentioned additional remarks applies to the following embodiments.

Embodiment 2

The front knitted fabric 10 may have a plurality of the bottomed holes 40. The surface 13 of the front knitted fabric 10 may have a pattern 14 of the bottomed holes 40. The present embodiment can provide a novel double knit circular knitted fabric having the pattern formed by the bottomed holes on the surface.

Embodiment 3

The bottomed holes 40 may include a bottomed slot 44 having a longitudinal direction oriented in a warp direction D2. The present embodiment can provide a double knit circular knitted fabric having the bottomed slot on the surface, the bottomed slot having the longitudinal direction oriented in the warp direction.

Embodiment 4

Another embodiment of the present disclosure provides a knitted product comprising the double knit circular knitted fabric 1. The present embodiment can provide a knitted product including the novel double knit circular knitted fabric capable of preventing the scraps from penetrating from the surface hole into the space between the front knitted fabric and the back knitted fabric inexpensively.

Herein, examples of the knitted product include a product shaped by cutting the double knit circular knitted fabric, a product formed by processing an edge of a cut double knit circular knitted fabric by sewing or the like, a product formed by sewing cut double knit circular knitted fabrics together, and the like. The knitted product may include at least one accessory different from the double knit circular knitted fabric. Examples of the knitted product include a cover material for a vehicle seat, a cover material for a child seat, a cover material for a care bed, and the like.

Figure 4:
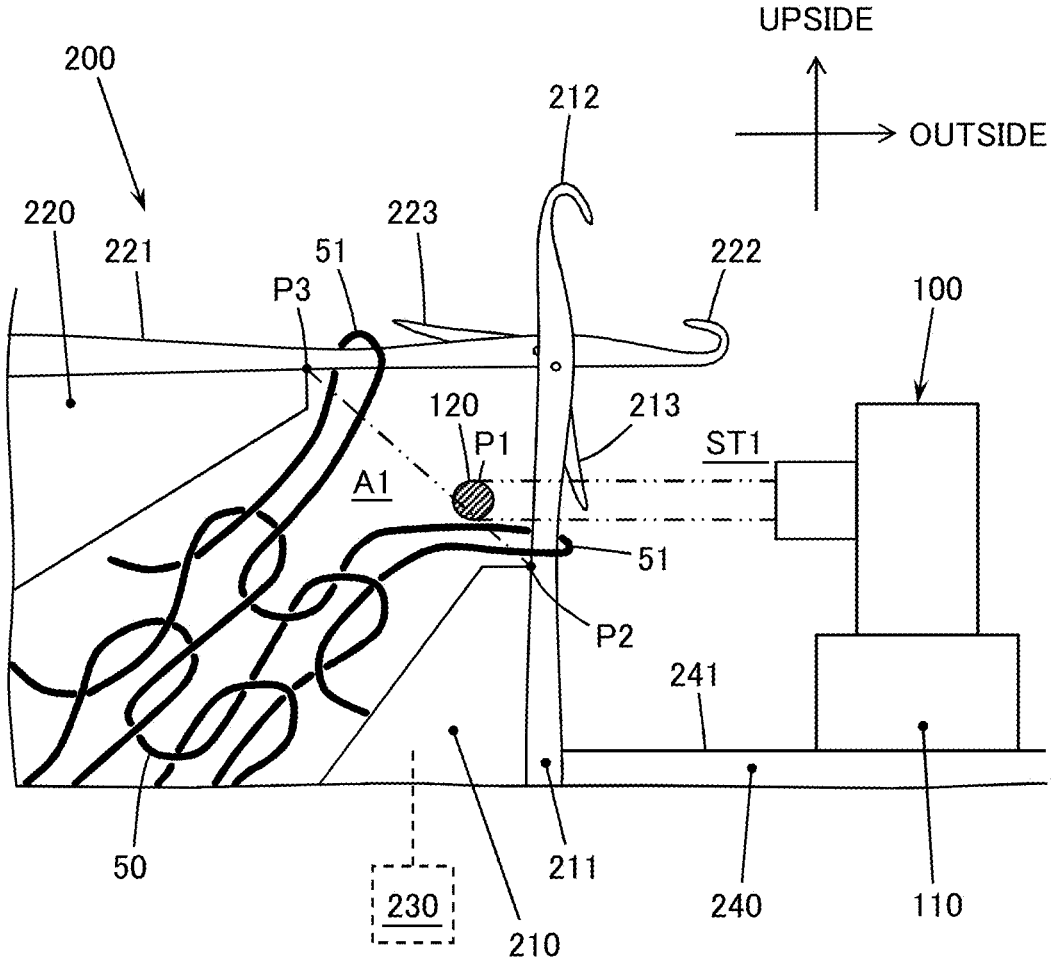
FIG. 4 is a schematic view showing an example of an essential part of a double knit circular knitting machine to which a knitted fabric holding attachment is attached.

The above-mentioned double knit circular knitted fabric 1 can be produced by a double knit circular knitting machine 200 including a needle cylinder 210 on which cylinder needles 211 are arranged, a needle dial 220 on which dial needles 221 are arranged, a needle selector 230, and a support body 240 located outside the needle cylinder 210, as exemplified in FIG. 4. In the case that the double knit circular knitted fabric 1 is thick like the corrugated knitted fabric, it is necessary to raise the position of the needle dial 220 to widen the gap between the needle cylinder 210 and the needle dial 220. As the position of the needle dial 220 is raised, the knitted fabric 50 connected to knitted yarns 51 is lifted, and thereby, there is a possibility that the knitted yarns 51 get entangled without a knitted fabric holding attachment. Thus, it is conceivable that a knitted fabric holding attachment is attached to the support body 240, the knitted fabric holding attachment holding the knitted fabric 50 so as to prevent the knitting yarns 51 from getting entangled at a holding position P1 between the cylinder needles 211 and the dial needles 221.

In order to knit a double knit circular knitted fabric having a pattern such as bottomed holes 40, a knitted fabric holding attachment was attached to the support body 240, the knitted fabric holding attachment including an attachment base attached to the support body 240 and a rigid metal plate leading to the holding position P1 from the attachment base. In this case, scratches were formed on the double knit circular knitted fabric.

Figure 10:
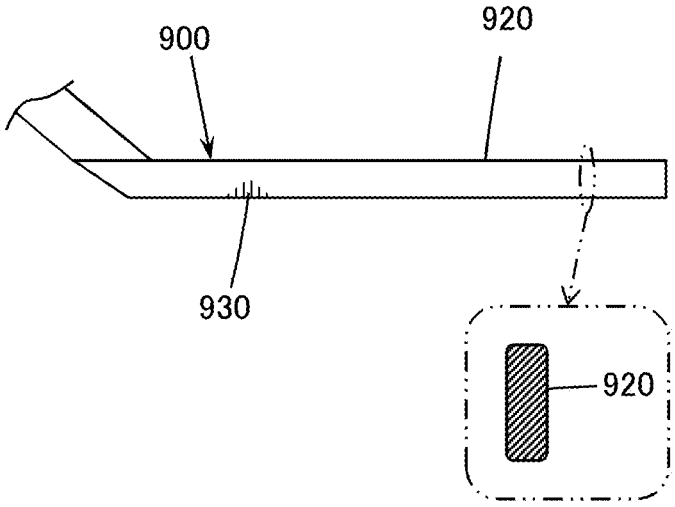
FIG. 10 is a schematic view showing a knitted fabric holding attachment including a rigid metal plate having a worn area according to a comparative example.

FIG. 10 schematically shows a knitted fabric holding attachment 900 according to a comparative example. The knitted fabric holding attachment 900 includes a rigid metal plate 920 holding the knitted fabric between the cylinder needles and the dial needles to prevent the knitting yarns from getting entangled. As shown within the double-dotted enclosures in FIG. 10, the cross section of the rigid metal plate 920 is approximately rectangular. Upon inspection of the knitted fabric holding attachment 900, a worn area 930 formed by the cylinder needles hitting the rigid metal plate 920 was identified on the vertical surface of the rigid metal plate 920, the vertical surface facing the cylinder needles.

Figure 11:
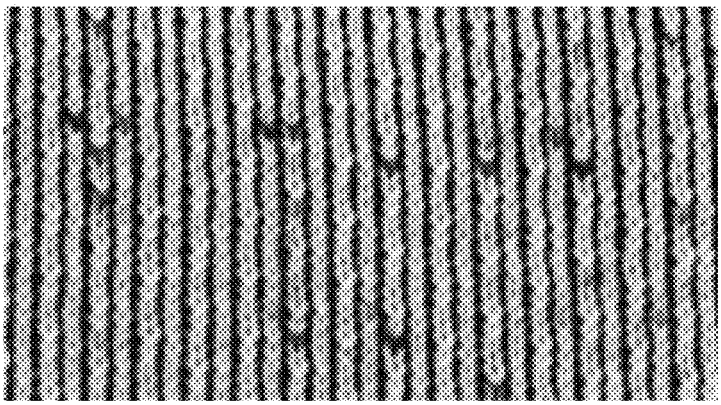
FIG. 11 is a photograph showing a sample of a double knit circular knitted fabric according to a comparative example.

FIG. 11 schematically shows a photograph of a sample of a double knit circular knitted fabric according to a comparative example.

Upon verifying the operation of the double knit circular knitting machine, it was found that scratches such as yarn breakages shown in FIG. 11 were formed on the double knit circular knitted fabric due to the knitted yarns getting caught on the worn area 930 on the rigid metal plate 920.

Thus, it is desired to prevent the scratches from being formed on the double knit circular knitted fabric due to the knitted yarns getting caught on the worn area on the knitted fabric holding attachment.

Embodiment 5

Figure 3:
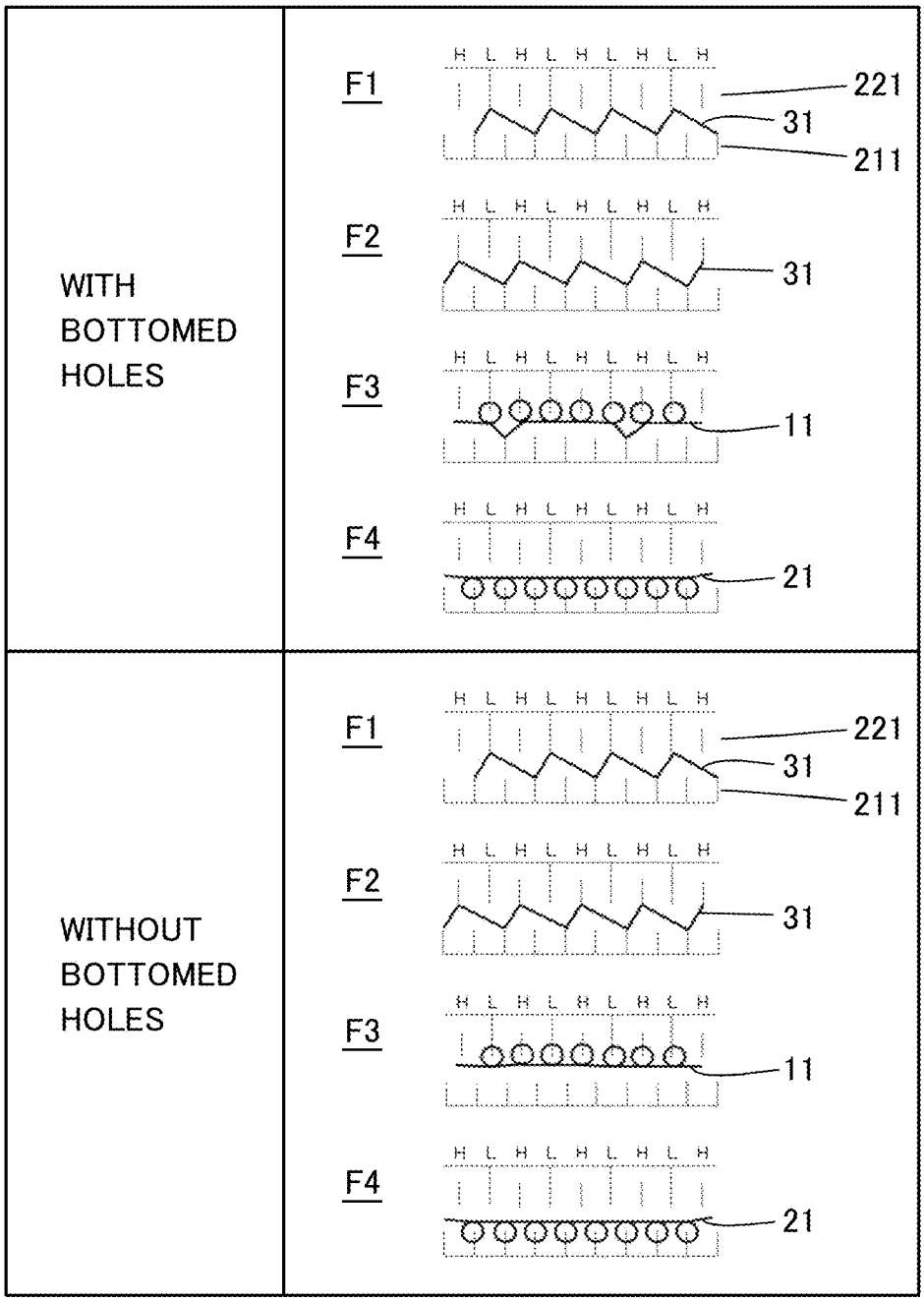
FIG. 3 is a schematic organizational chart showing an example of knitting of a double knit circular knitted fabric.

As exemplified in FIGS. 3 and 4, another embodiment of the present disclosure provides a method for manufacturing a double knit circular knitted fabric 1 using a double knit circular knitting machine 200 including a needle cylinder 210 on which cylinder needles 211 are arranged, a needle dial 220 on which dial needles 221 are arranged, a needle selector 230, and a support body 240 located outside the needle cylinder 210. The method comprises the following steps:

(a1) A holding step ST1 of holding a knitted fabric 50 with a spring steel wire (steel wire for spring) 120 so as to prevent knitting yarns 51 from getting entangled at a holding position P1 between the cylinder needles 211 and the dial needles 221, the spring steel wire leading to the holding position P1 from an attachment base 110 attached to the support body 240.

(a2) A control step ST2 of controlling operations of the cylinder needles 211 and the dial needles 221, and a supply of the knitting yarns 51 so as to the double knit circular knitted fabric 1 is knitted, the knitting yarns 51 including front yarns 11, back yarns 21, and binding yarns 31, the double knit circular knitted fabric 1 including a front knitted fabric 10 having a first stitch structure 12 of the front yarns 11, a back knitted fabric 20 having a second stitch structure 22 of the back yarns 21, and a binding structure 30 in which the front knitted fabric 10 and the back knitted fabric 20 are bound together with the binding yarns 31, the front knitted fabric 10 having a bottomed hole 40 that is recessed from a surface 13 of the front knitted fabric 10 and connected to the back knitted fabric 20, the front yarns 11 being drawn into the back knitted fabric 20, and the front yarns 11 being located on a side 43 of the bottomed hole 40.

When the needles hit the spring steel wire 120, the spring steel wire 120 bends by its elasticity. This prevents the specific area of the spring steel wire 120 from wearing down. Consequently, it is possible to produce the double knit circular knitted fabric 1 in which the scratches are prevented, the scratches being formed due to the knitted yarns 51 getting caught on the worn area on the knitted fabric holding attachment. In the obtained double knit circular knitted fabric 1, the front yarns 11 are located on the side 43 of the bottomed hole 40 that is recessed from the surface 13 and connected to the back knitted fabric 20. This prevents the scraps from penetrating from the bottomed hole 40 into the space between the front knitted fabric 10 and the back knitted fabric 20. Thus, the above embodiment can provide the method for manufacturing the double knit circular knitted fabric capable of preventing the scraps from penetrating from the surface hole into the space between the front knitted fabric and the back knitted fabric inexpensively.

Herein, examples of the spring steel wire include piano wires, stainless steel wires for springs, hard drawn steel wires suitable for springs (e.g. oil tempered wires for mechanical springs), and the like. This additional remark applies to the following embodiments.

Embodiment 6

The spring steel wire 120 may be oval in cross section with a maximum diameter of 0.7 to 1.2 mm, including circular in cross section with a diameter of 0.7 to 1.2 mm.

In this case, the spring steel wire 120 that the cylinder needles 211 hit escapes laterally from the cylinder needles 211, the spring steel wire 120 being oval (including circular) in cross section. This further prevents the specific area of the spring steel wire 120 from wearing down. According to the above embodiment, it is possible to further prevent the scratches on the double knit circular knitted fabric, the scratches being formed due to the knitted yarns getting caught on the worn area on the knitted fabric holding attachment.

Embodiment 7

The knitted fabric holding attachment 100, which includes the attachment base 110 and the spring steel wire 120, prevents the above-mentioned scratches on the double knit circular knitted fabric 1, and realizes the double knit circular knitted fabric 1 capable of preventing the scraps from penetrating from the hole of the surface 13 into the space between the front knitted fabric 10 and the back knitted fabric 20 inexpensively. Another embodiment of the present disclosure provides the knitted fabric holding attachment 100 to be attached to the double knit circular knitting machine 200. The knitted fabric holding attachment 100 holds the knitted fabric 50 so as to prevent the knitting yarns 51 from getting entangled at the holding position P1 between the cylinder needles 211 and the dial needles 221. The knitted fabric holding attachment 100 comprises the attachment base 110 to be attached to the support body 240, and the spring steel wire 120 that leads to the holding position P1 from the attachment base 110 so as to hold the knitted fabric 50 at the holding position P1.

When the needles hit the spring steel wire 120, the spring steel wire 120 bends by its elasticity. This prevents the specific area of the spring steel wire 120 from wearing down. Thus, the above embodiment can provide a knitted fabric holding attachment capable of preventing the scratches on the double knit circular knitted fabric, the scratches being formed due to the knitted yarns getting caught on the worn area on the knitted fabric holding attachment.

As described above, the spring steel wire 120 may be oval in cross section with the maximum diameter of 0.7 to 1.2 mm, including circular in cross section with the diameter of 0.7 to 1.2 mm.

(2) Specific Examples of the Double Knit Circular Knitted Fabric

FIG. 1 schematically exemplifies a specific example of the double knit circular knitted fabric 1 used for the cover material for the vehicle seat. FIG. 2 schematically exemplifies the knitting structure of the double knit circular knitted fabric 1 as the specific example. It should be noted that each of the figures disclosed in present application is merely a schematic drawing for the purpose of explaining the specific examples in an easily understandable manner. For example, the thickness of the double knit circular knitted fabric 1 in FIG. 1 is exaggerated, and the stitch structures 12 and 22 shown in FIG. 2 are simplified.

The double knit circular knitted fabric 1 shown in FIGS. 1 and 2 is a thick corrugated knitted fabric including the front knitted fabric 10, the back knitted fabric 20, and the binding structure 30. The double knit circular knitted fabric 1 according to the present specific example is a novel corrugated knitted fabric having the bottomed holes 40 that are recessed from the surface 13 of the front knitted fabric 10. The double knit circular knitted fabric 1 is knitted by a double knit circular knitting machine 200 to which novel knitted fabric holding attachments 100 are attached as exemplified in FIGS. 4 to 6. FIG. 1 shows that the surface 13 has a mesh pattern as a pattern 14 of the bottomed holes 40.

The double knit circular knitted fabric 1 has a knitting structure along the weft direction D1 as shown in FIG. 2. When the knitting structure shown in FIG. 2 is repeated in the warp direction D2 crossing the weft direction D1, the bottomed slots 44 having the longitudinal direction oriented in the warp direction D2 is formed as the bottomed holes 40.

The front knitted fabric 10 has a stitch structure 12 of the front yarns 11 that are weft yarns. The back knitted fabric 20 has a stitch structure 22 of the back yarns 21 that are weft yarns. The binding structure 30 is a tuck structure that binds the front knitted fabric 10 and the back knitted fabric 20 together with the binding yarns 31 that are weft yarns. The front knitted fabric 10 has the bottomed holes 40 that are recessed from the surface 13 of the front knitted fabric 10 and connected to the back knitted fabric 20. At the position of the bottomed holes 40, the front yarns 11 are caught and drawn into the stitch structure 22 of the back yarns 21. As a result, each of the bottomed holes 40 has an opening 41 on the surface 13. The front yarns 11 have portions caught in the back knitted fabric 20, the portions being located at the bottoms 42 of the bottomed holes 40. The front yarns 11 drawn into the back knitted fabric 20 are located on the sides 43 of the bottomed holes 40. The front yarns 11 drawn into the back knitted fabric 20 prevent the scraps (301 and 302) from penetrating between the front knitted fabric 10 and the back knitting 20 even if the scraps (301 and 302) enter the bottomed holes 40, as shown in FIG. 8.

The type of the front yarn 11, the back yarn 21, and the binding yarn 31 is not particularly limited. Examples of the front yarn 11, the back yarn 21, and the binding yarn 31 includes filaments of synthetic fibers, spun yarns of synthetic fibers, spun yarns of natural fibers, blended yarns, twisted union yarns, combined filament yarns, and the like. Examples of the synthetic fibers include polyester fibers, polyamide fibers, acrylic fibers, polyolefin fibers, and the like. Examples of the natural fibers include wool, cotton, hemp, and the like. Dyed yarns may also be used for these yarns. The thickness of the front yarn 11, the back yarn 21, and binding yarns 31 is not particularly limited. Of course, different types of yarns may be used for the front yarn 11, the back yarn 21, and the binding yarns 31.

Examples of the stitch structures 12 and 22 include various structures such as a plain knitting (flat knitting) structure, a rib knitting structure, a pearl knitting structure, and the like.

The depth of the bottomed hole 40 may be, for example, 1.0 to 4.0 mm. To increase the depth of the bottomed hole 40, it is sufficient to raise the needle dial 220 (refer to FIG. 4) to thicken the double knit circular knitted fabric 1. To decrease the depth of the bottomed hole 40, it is sufficient to lower the needle dial 220 to thin the double knit circular knitted fabric 1.

(3) Specific Examples of the Method for Manufacturing the Double Knit Circular Knitted Fabric FIG. 3 schematically exemplifies a knitting organizational chart of the double knit circular knitted fabric 1. The upper part of FIG. 3 shows needle arrangements for feeders F1 to F4 in the portion where the bottomed holes 40 are formed in the courses. The lower part of FIG. 3 shows needle arrangements for the feeders F1 to F4 in the portion where the bottomed holes 40 are not formed in the courses. In each of the needle arrangements, the arrangement of the cylinder needles 211 is shown below, and the arrangement of the dial needles 221 is shown above. The control step ST2 is carried out according to the organizational chart shown in FIG. 3.

The feeder F1 supplies the binding yarn 31 for the tuck structure to a part of the needles (211 and 221). The feeder F2 following the feeder F1 supplies the binding yarn 31 for the tuck structure to the needles (211 and 221) at positions different from the yarn feeding position from the feeder F1. The feeder F3 following the feeder F2 supplies the front yarn 11 to the dial needles 221. The dial needles 221 knit the stitch structure 12 of the front yarns 11 by knitting operation. The structure corresponding to the feeder F3 includes the tuck structure. The feeder F4 following the feeder F3 supplies the back yarn 21 to the cylinder needles 211. The cylinder needles 211 knit the stitch structure 22 of the back yarns 21 by knitting operation. The front yarn 11 supplied from the feeder F3 is drawn into the stitch structure 22 of the back yarns 21 at positions of the bottomed holes 40.

As a result, the tubular double knit circular knitted fabric 1 in which the front knitted fabric 10 and the back knitted fabric 20 are bound together with the binding yarns 31 is knitted. In the double knit circular knitted fabric 1, the front knitted fabric 10 having the bottomed holes 40 is inside the back knitted fabric 20.

In the case of forming one course of the bottomed holes 40 in the warp direction D2, the knitting "without bottomed holes" as shown in the lower part of FIG. 3, the knitting of one course "with bottomed holes" as shown in the upper part of FIG. 3, and the knitting "without bottomed holes" as shown in the lower part of FIG. 3 are carried out in this order. In the case of forming the bottomed slots 44, the knitting shown in the upper part of FIG. 3 is repeated for multiple courses. In the case of forming N courses of the bottomed holes 40 in the warp direction D2, the knitting "without bottomed holes", the knitting of N courses "with bottomed holes", and the knitting "without bottomed holes" are carried out in this order. Herein, N is an integer of 2 or more.

FIG. 4 schematically exemplifies an essential part of the double knit circular knitting machine 200 to knit the double knit circular knitted fabric 1.

The double knit circular knitting machine 200 includes the needle cylinder 210 on which the cylinder needles 211 are arranged, the needle dial 220 on which the dial needles 221 are arranged, the needle selector 230, and the support body 240 located outside the needle cylinder 210. Each of the cylinder needles 211 is a latch needle in which a hook 212 at the tip opens and closes by a latch 213, and is arranged so that the cylinder needle 211 can advance and retract vertically relative to the needle cylinder 210. Each of the dial needles 221 is a latch needle in which a hook 222 at the tip opens and closes by a latch 223, and is arranged so that the dial needle 221 can advance and retract horizontally relative to the needle dial 220. In the example shown in FIG. 3, the knitting yarn 51 caught by the cylinder needle 211 is the front yarn 11 or the binding yarn 31, and the knitting yarn 51 caught by the dial needle 221 is the back yarn 21 or the binding yarn 31. The needle dial 220 is supported on a support portion (not shown) of the double knit circular knitting machine 200 so that the height of the needle dial 220 can be changed. The needle selector 230 individually controls the operation of the cylinder needles 211. The needle selector 230 may individually control the operation of the dial needles 221. The double knit circular knitting machine 200 includes a control unit. The control unit includes, for example, a CPU (Central Processing Unit), a ROM (Read Only Memory), and a RAM (Random Access Memory). The needle selector 230 individually controls the operation of the needles according to signals from the control unit.

In the case that the double knit circular knitted fabric 1 is thick, it is necessary to raise the position of the needle dial 220 to widen the gap between the needle cylinder 210 and the needle dial 220. As the position of the needle dial 220 is raised, the knitted fabric 50 connected to the knitted yarns 51 is lifted, and thereby, the chance of the knitted yarns 51 getting entangled becomes high. Thus, the knitted fabric holding attachment 100 is attached to the upper surface 241 of the support body 240, the knitted fabric holding attachment 100 holding the knitted fabric 50 so as to prevent the knitting yarns 51 from getting entangled at the holding position P1 between the cylinder needles 211 and the dial needles 221.

In the case of attaching the knitted fabric holding attachment 900 according to the comparative example shown in FIG. 10 to the support body 240 to knit the double knit circular knitted fabric having the pattern such as the bottomed holes 40, the scratches as shown in FIG. 11 were formed on the sample of the double knit circular knitted fabric. The knitted fabric holding attachment 900 shown in FIG. 10 includes the rigid metal plate 920 leading to the holding position P1 from the attachment base to be attached to the upper surface 241 shown in FIG. 4. The worn area 930 by the cylinder needles hitting the rigid metal plate 920 was identified on the vertical surface of the rigid metal plate 920, the vertical surface facing the cylinder needles. Upon verifying the operation of the double knit circular knitting machine 200, it was found that scratches shown in FIG. 11 were formed on the double knit circular knitted fabric due to the knitted yarns 51 getting caught on the worn area 930 on the rigid metal plate 920.

The knitting yarn 51 is fed at a constant speed from the feeders to the needles (211 and 221) by a yarn feeding device. If a double knit circular knitted fabric is a plain corrugated knitted fabric without a pattern such as the bottomed holes 40, the cylinder needles 211 in addition to the dial needles 221 operate regularly. For this reason, the operation that the knitting yarns 51 pull the cylinder needle 211 towards the inner side of the needle cylinder 210 does not occur. As a result, the cylinder needles 211 coming out of the needle cylinder 210 do not hit the rigid metal plate 920.

In the case that the double knit circular knitted fabric has the pattern such as the bottomed holes 40, the extent of the cylinder needles 211 coming out of the needle cylinder 210 becomes irregular. This sometimes causes the knitting yarns 51 to pull the cylinder needles 211 towards the inside of the needle cylinder 210. For example, in the case that the extent of the cylinder needles 211 coming out of the needle cylinder 210 is small, the knitting yarns 51 become loose, and in the case that the extent of the cylinder needles 211 coming out of the needle cylinder 210 is large, the knitting yarns 51 pull the cylinder needles 211 towards the inside of the needle cylinder 210. The cylinder needles 211 moving towards the inside hit the rigid metal plate 920, and thereby, the worn area 930 is formed on the rigid metal plate 920.

Due to the above reason, in the double knit circular knitting machine equipped with the knitted fabric holding attachments 900, the double knit circular knitted fabric having the pattern such as the bottomed holes 40 has not been produced. Furthermore, the double raschel knitted fabric having a mesh structure is expensive.

In the present specific example, the knitted fabric holding attachments 100 including the spring steel wire 120 that holds the knitted fabric 50 at the holding position P1 is attached to the double knit circular knitting machine 200. As a result, it is possible to obtain the novel double knit circular knitted fabric 1 having the pattern without the scratches by carrying out the holding step ST1 shown in FIG. 4 and the control step ST2 shown in FIG. 3.

Figure 5:
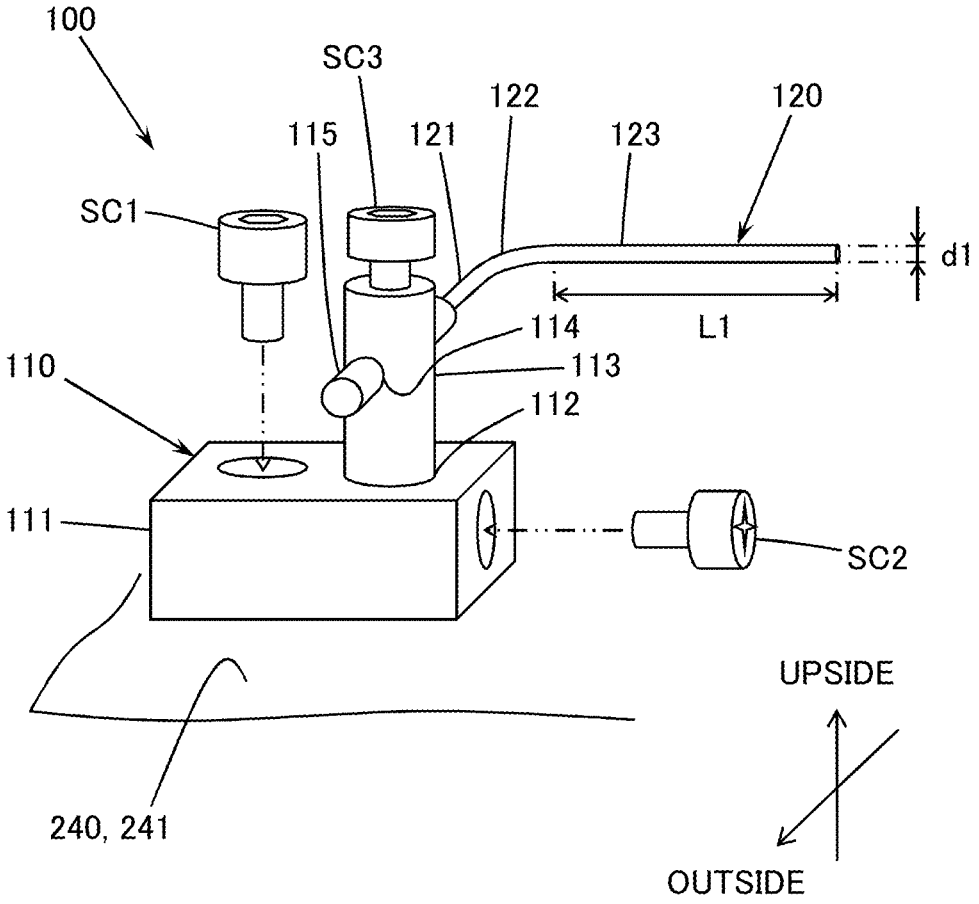
FIG. 5 is a schematic perspective view showing an example of a knitted fabric holding attachment.
Figure 6:
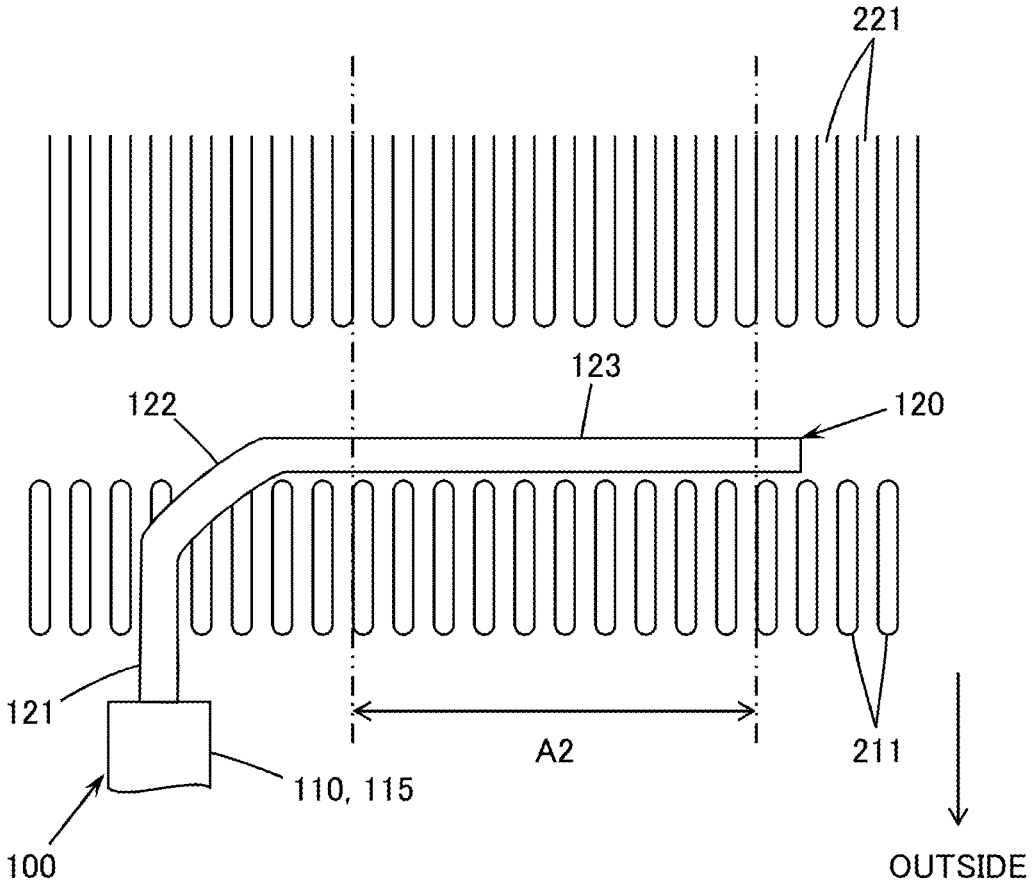
FIG. 6 is a schematic plan view showing an example of a positional relation between needles and a knitted fabric holding attachment.

FIG. 5 schematically exemplifies the knitted fabric holding attachment 100 to be attached to the double knit circular knitting machine 200. FIG. 6 schematically exemplifies a positional relation between the needles (211 and 221) and the knitted fabric holding attachment 100.

The knitted fabric holding attachment 100 includes the attachment base 110 and the spring steel wire 120. The attachment base 110 includes a horizontal plane portion 111 having a vertically oriented hole 112, a vertical shaft portion 113 having a horizontally oriented through hole 114, and a wire support portion 115. In FIG. 5, the hole 112 is hidden by the vertical shaft portion 113. The spring steel wire 120 includes a base part 121 to be supported by the wire support portion 115, a fabric holding part 123 to be positioned at the holding position P1, and a bent part 122 that is oriented from the base part 121 and connected to the fabric holding part 123 whose longitudinal direction is different from that of the base part 121. The wire support portion 115 supports the base part 121 so that the fabric holding part 123 can hold the knitted fabric 50 at the holding position P1, and is fixed to the vertical shaft portion 113 by a screw SC3 with the support portion 115 passing through the through hole 114. The vertical shaft portion 113 is fixed to the horizontal plane portion 111 by a screw SC2 with its lower part in the hole 112. The horizontal plane portion 111 is fixed to the upper surface 241 of the support body 240 by a screw SC1 so that the fabric holding part 123 can hold the knitted fabric 50 at the holding position P1. In this way, the attachment base 110 is attached to the support body 240, and the spring steel wire 120, which leads to the holding position P1 from the attachment base 110, holds the knitted fabric 50 at the holding position P1.

Steel wires with elasticity can be used for the spring steel wire 120. Examples of the spring steel wire 120 include piano wires, stainless steel wires for springs, and hard drawn steel wires suitable for springs, and the like. Piano wires are typically formed from high quality piano wire rods with a carbon content of 0.60 to 0.95%, and have stable elasticity suitable for high-class springs. Thus, a piano wire is a preferred material for the spring steel wire 120. Since the spring steel wire 120 has the elasticity as a spring, the spring steel wire 120 that the cylinder needles 211 hit bends due to the elasticity. This prevents the spring steel wire 120 from being worn. As a result, it is possible to obtain the patterned double knit circular knitted fabric 1 in which the scratches are prevented, the scratches being formed due to the knitted yarns 51 getting caught on the worn area on the knitted fabric holding attachment.

The cross section of the spring steel wire 120 is preferably oval (including circular). In the case that the cross section of the rigid metal plate 920 is substantially rectangular like the comparative example shown in FIG. 10, the worn area 930 is easily formed at the corner of the rigid metal plate 920 because the cylinder needles 211 irregularly coming out of the needle cylinder 210 hit the corner of the rigid metal plate 920. Since the spring steel wire 120 whose cross section is oval (including circular) has no corner, the spring steel wire 120 is less likely to wear even if the cylinder needles 211 hit the spring steel wire 120. In the case that the cross section of the spring steel wire 120 is oval (including circular), the spring steel wire 120 escapes laterally from the cylinder needles 211. This prevents the specific area of the spring steel wire 120 from wearing down.

In order to hold the knitted fabric 50 at the holding position P1 and prevent the knitting yarns 51 from getting entangled, it is preferable that the diameter d1 of the spring steel wire 120 with a circular cross section is greater than or equal to 0.7 mm. In the case that the cross section of the spring steel wire 120 is oval, it is preferable that the maximum diameter of the cross section of the spring steel wire 120 is greater than or equal to 0.7 mm. Furthermore, in order to allow the spring steel wire 120 that hit the cylinder needles 211 to escape easily to the side of the cylinder needles 211, it is preferable that the diameter d1 of the spring steel wire 120 with the circular cross section is less than or equal to 1.2 mm. In the case that the cross section of the spring steel wire 120 is oval, it is preferable that the maximum diameter of the cross section of the spring steel wire 120 is less than or equal to 1.2 mm. The diameter d1 or maximum diameter of the cross section of the spring steel wire 120 should be adjusted according to the gauge of the double knit circular knitting machine 200 or the thickness of the knitting yarns 51.

As shown in FIG. 4, it is preferable that the holding position P1 is a position where the fabric holding part 123 (spring steel wire 120) is located in at least part of an area A1. The area A1 is inside of a line connecting the position P2 where the cylinder needles 211 come out of the needle cylinder 210 and the position P3 where the dial needles 221 come out of the needle dial 220 in the double knit circular knitting machine 200.

As shown in FIG. 6, the fabric holding part 123 covers a needle advancing and retracting range A2 where the needles (211 and 221) advance and retract corresponding to the yarn supplied from the feeder. It is preferable that the length L1 (refer to FIG. 5) of the fabric holding part 123 exceeds the needle advancing and retracting range A2. In the case that the length of the needle advancing and retracting range A2 is 1 inch, the length L1 of the fabric holding part 123 may be, for example, 26 to 40 mm, preferably 27 to 35 mm, and more preferably 28 to 30 mm.

The above-mentioned knitted fabric holding attachment 100 is attached to the support body 240 so that the fabric holding part 123 can be positioned at the holding position P1 within the needle advancing and retracting range A2 corresponding to the feeder where the knitting operation is carried out. For example, as shown in the organizational chart in FIG. 3, the knitted fabric holding attachments 100 are attached to the support body 240 so that the fabric holding parts 123 can be positioned at the holding positions P1 within the needle advancing and retracting ranges A2 corresponding to the feeders F3 and F4 where the knitting operations are carried out, respectively.

The double knit circular knitted fabric 1 having the pattern such as the bottomed holes 40 is produced by the double knit circular knitting machine 200 by carrying out the holding step ST1 and the control step ST2. In the holding step ST1, the spring steel wire 120 holds the knitted fabric 50 so as to prevent knitting yarns 51 from getting entangled at the holding position P1. In the control step ST2, the double knit circular knitting machine 200 (particularly the control unit and the needle selector 230) controls the operation of the needles (cylinder needles 211 and dial needles 221) and the supply of the knitted yarns 51 so as to knit the double knit circular knitted fabric 1 having the bottomed holes 40. As a result, the novel double knit circular knitted fabric 1, in which the front yarns 11 are located on the sides 43 of the bottomed holes 40 that are recessed from the surface 13 and connected to the back knitted fabric 20, is knitted.

When cylinder needles 211 pulled by the knitting yarns 51 hit the spring steel wire 120, the spring steel wire 120 bends by its elasticity. This prevents the specific area of the spring steel wire 120 from wearing down. Consequently, it is possible to produce the novel double knit circular knitted fabric 1 in which the scratches are prevented, the scratches being formed due to the knitted yarns 51 getting caught on the worn area on the knitted fabric holding attachment. In the obtained double knit circular knitted fabric 1, as shown in FIGS. 1 and 2, the front yarns 11 are located on the sides 43 of the bottomed holes 40.

Figure 7:
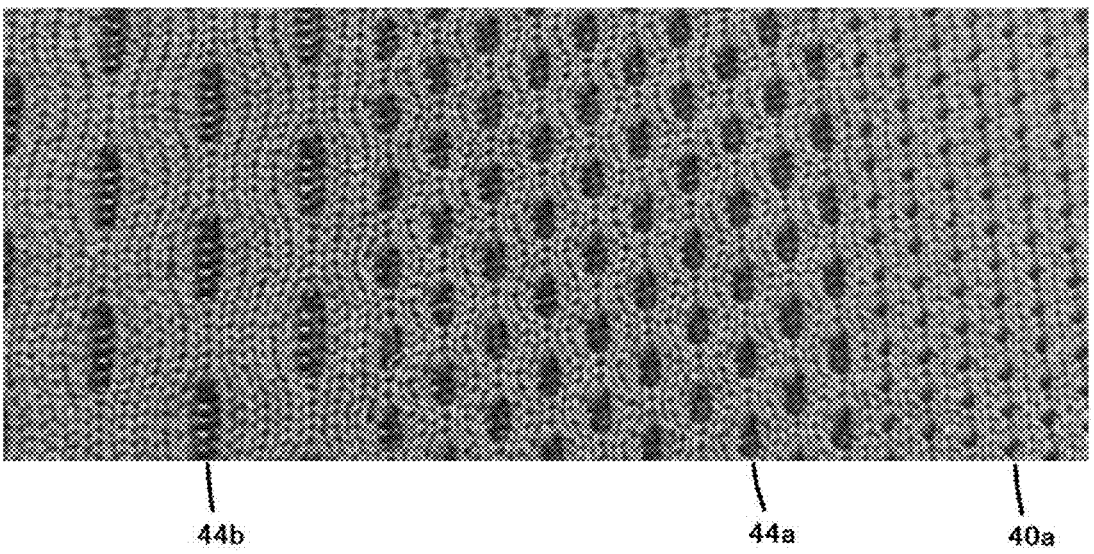
FIG. 7 is a photograph showing a sample of a double knit circular knitted fabric.

FIG. 7 shows a photograph of a sample obtained by actually knitting the double knit circular knitted fabric having the bottomed holes 40 according to the organizational chart shown in FIG. 3. The bottomed holes 40 of the double knit circular knitted fabric sample shown in FIG. 7 include one course of the bottomed holes 40*a* in the warp direction D2, two courses of the bottomed slots 44*a* in the warp direction D2, and six courses of the bottomed slots 44*b* in the warp direction D2. FIG. 7 shows that a mesh pattern as a pattern of the bottomed holes was formed on the surface of the double knit circular knitted fabric sample. No scratches as shown in the comparative example in FIG. 11 are observed in the double knit circular knitted fabric sample shown in FIG. 7. Therefore, by attaching the knitted fabric holding attachment 100 including the spring steel wire 120 to the double knit circular knitting machine 200, it has been confirmed that it is possible to produce the novel double knit circular knitted fabric 1 having the pattern without the scratches.

In the double raschel knitted fabric 801 according to the comparative example shown in FIG. 9, due to the structure of the double raschel machine, the front yarns 11 are not drawn into the back knitted fabric. In this case, if the scraps (301 and 302) enter the holes 840 visible on the front knitted fabric, the scraps (301 and 302) penetrate between the front knitted fabric and the back knitted fabric. As a result, it sometimes happens that it is impossible to remove these scraps (301 and 302) from the double raschel knitted fabric 801.

In the double knit circular knitted fabric 1 shown in FIG. 8, the front yarns 11 are located on the sides 43 of the bottomed holes 40. This prevents the scraps (301 and 302) from penetrating from the bottomed holes 40 into the space between the front knitted fabric 10 and the back knitted fabric 20. Therefore, the double knit circular knitted fabric 1 is a novel knitted fabric that can prevent the scraps from penetrating from the surface hole into the space between the front knitted fabric and the back knitted fabric inexpensively.

According to the organizational chart shown in FIG. 3, it is possible to easily knit the double knit circular knitted fabric 1 having the bottomed slots 44 having the longitudinal direction oriented in the warp direction D2. Therefore, the present embodiment can easily provide the novel double knit circular knitted fabric having the bottomed slots on the surface, the bottomed slots having the longitudinal direction oriented in the warp direction.

(4) Specific Examples of the Knitted Product

Examples of the knitted product include a cover material for an automobile seat, a cover material for a child seat, a cover material for a care bed, and the like, the knitted product including the double knit circular knitted fabric 1. The knitted product as the cover material for the seat can be produced, for example, by cutting the double knit circular knitted fabric 1 to fit the shape of the seat and processing the edge of the cut double knit circular knitted fabric through sewing or the like. The knitted product such as the cover material for the seat may be produced by sewing the cut double knit circular knitted fabrics together. The knitted product may be produced by sewing at least one accessory to the cut double knit circular knitted fabric.

(5) Modified Example

Various modified examples of the present invention are available.

For example, in the case that the needle selector 230 controls the operation of the dial needles 221 individually, it is possible to knit a tubular double knit circular knitted fabric 1 in which the front knitted fabric 10 having the bottomed holes 40 is outside the back knitted fabric 20.

In the case that the needle selector 230 controls the operations of the cylinder needles 211 and the dial needles 221 individually, it is possible to knit a double knit circular knitted fabric having bottomed slots that have the longitudinal direction oriented in the weft direction D1. Furthermore, the size of the bottomed hole 40 may be at least two courses in the warp direction D2 and at least two wales in the weft direction D1. A double knit circular knitted fabric having the abovementioned bottomed holes 40 can also be formed. A double knit circular knitted fabric having more complex shapes of the bottomed holes 40 can also be formed.

The attachment base 110 of the knitted fabric holding attachment 100 is not limited to the combination of three members (111, 113 and 115). For example, the attachment base 110 may include a member formed integrally so that the horizontal plane portion 111 and the vertical shaft portion 113 cannot be separable, or a member formed integrally so that the vertical shaft portion 113 and the wire support portion 115 cannot be separable. Of course, the attachment base 110 may be a member formed integrally so that the three portions (111, 113 and 115) cannot be separable.

The shape of the spring steel wire 120 can be appropriately modified as long as the spring steel wire 120 includes a fabric holding part 123. For example, the spring steel wire 120 may be consist of the fabric holding part 123 and a connecting part that is oriented from the attachment base 110 and connected to the fabric holding part 123 whose longitudinal direction is different from that of the attachment base 110.

(6) Conclusion

As explained above, according to the present invention, it is possible to provide the novel double knit circular knitted fabric capable of preventing the scraps from penetrating from the surface hole into the space between the front knitted fabric and the back knitted fabric inexpensively, the knitted product including the double knit circular knitted fabric, the method for manufacturing the double knit circular knitted fabric, and the knitted fabric holding attachment to be used in the manufacturing method, and the like, in various embodiments. Of course, configurations consisting of the components in each independent claim can produce the above-mentioned primary operation and effect.

It is also possible to implement configurations formed by exchanging or combining the components disclosed in the above-mentioned examples with each another, configurations formed by exchanging or combining components in related art and the components disclosed in the above-mentioned examples with each another, etc. The present invention implies these configurations and the like.

EXPLANATION OF REFERENCE LETTERS

1 . . . double knit circular knitted fabric,
10 . . . front knitted fabric, 11 . . . front yarn, 12 . . . stitch structure, 13 . . . surface, 14 . . . pattern,
20 . . . back knitted fabric, 21 . . . back yarn, 22 . . . stitch structure,
30 . . . binding structure, 31 . . . binding yarn,
40 . . . bottomed hole, 41 . . . opening, 42 . . . bottom, 43 . . . side, 44 . . . bottomed slot,
50 . . . knitted fabric, 51 . . . knitting yarn,
100 . . . knitted fabric holding attachment,
110 . . . attachment base,
120 . . . spring steel wire, 123 . . . fabric holding part,
200 . . . double knit circular knitting machine,
210 . . . needle cylinder, 211 . . . cylinder needle,
220 . . . needle dial, 221 . . . dial needle,
230 . . . needle selector,
240 . . . support body, 241 . . . upper surface,
A1 . . . area, A2 . . . needle advancing and retracting range,
D1 . . . weft direction, D2 . . . warp direction,
d1 . . . diameter,
F1 to F4 . . . feeder,
L1 . . . length,
P1 . . . holding position,
ST1 . . . holding step, ST2 . . . control step.

What is claimed is:

1. A double knit circular knitted fabric comprising:
a front knitted fabric having a first stitch structure of front yarns;
a back knitted fabric having a second stitch structure of back yarns; and
a binding structure in which the front knitted fabric and the back knitted fabric are bound together with binding yarns, wherein
the double knit circular knitted fabric is a corrugated knitted fabric including the binding yarns that are different from both the front yarns and the back yarns,
the front knitted fabric has a bottomed hole that is recessed from a surface of the front knitted fabric and connected to the back knitted fabric, and
the front yarns drawn into the back knitted fabric are located on a side of the bottomed hole, the front yarns being different from the binding yarns.

2. The double knit circular knitted fabric according to claim 1, wherein
the front knitted fabric has a plurality of the bottomed holes, and
the surface of the front knitted fabric has a pattern of the bottomed holes.

3. The double knit circular knitted fabric according to claim 1, wherein
the front knitted fabric has a plurality of the bottomed holes, and
the bottomed holes include a bottomed slot having a longitudinal direction oriented in a warp direction.

4. A knitted product comprising the double knit circular knitted fabric according to claim 1.

* * * * *